US005154233A

United States Patent [19]

Gebhardt

[11] Patent Number: 5,154,233

[45] Date of Patent: Oct. 13, 1992

[54] WELL PROTECTION APPARATUS AND METHOD

[76] Inventor: Godfred L. Gebhardt, 5102 Encino Ct., Friendswood, Tex. 77546

[21] Appl. No.: 621,837

[22] Filed: Dec. 4, 1990

[51] Int. Cl.[5] ..... A62C 3/06

[52] U.S. Cl. ..... 169/45; 169/46; 169/52; 169/69

[58] Field of Search ..... 169/69, 43, 45, 46, 169/51, 52, 13, 16, 23

[56] References Cited

U.S. PATENT DOCUMENTS 1,697,376 1/1929 Wasson ..... 169/69
3,685,584 8/1972 Gracia ..... 169/69 X
3,771,604 11/1973 Norman et al. ..... 169/69 X

*Primary Examiner*—Margaret A. Focarino
*Assistant Examiner*—Andrew C. Pike

[57] ABSTRACT

The present method and apparatus are directed to a fire control system for use with a drilling rig. Multiple nozzle means are positioned around a drilling rig at selected locations to spray water delivered through fire hoses onto the rig to prevent fire damage. The equipment utilizes a skid-mounted engine and connected centrifugal pump for delivery of water from a closed storage tank. An engine control unit adjusts the throttle to an operating speed which delivers no water during normal operation. Subject to control by switch means on the rig floor, either hard wired or by means of a radio transmitter and receiver arrangement, the engine control unit switches the engine to maximum power output. An alarm is also sounded when this occurs. So long as the engine is running, operating lights signal rig personnel that the equipment is operative. The equipment is switched from a slow speed operation to a maximum power output to deliver water under control of rig personnel.

18 Claims, 1 Drawing Sheet

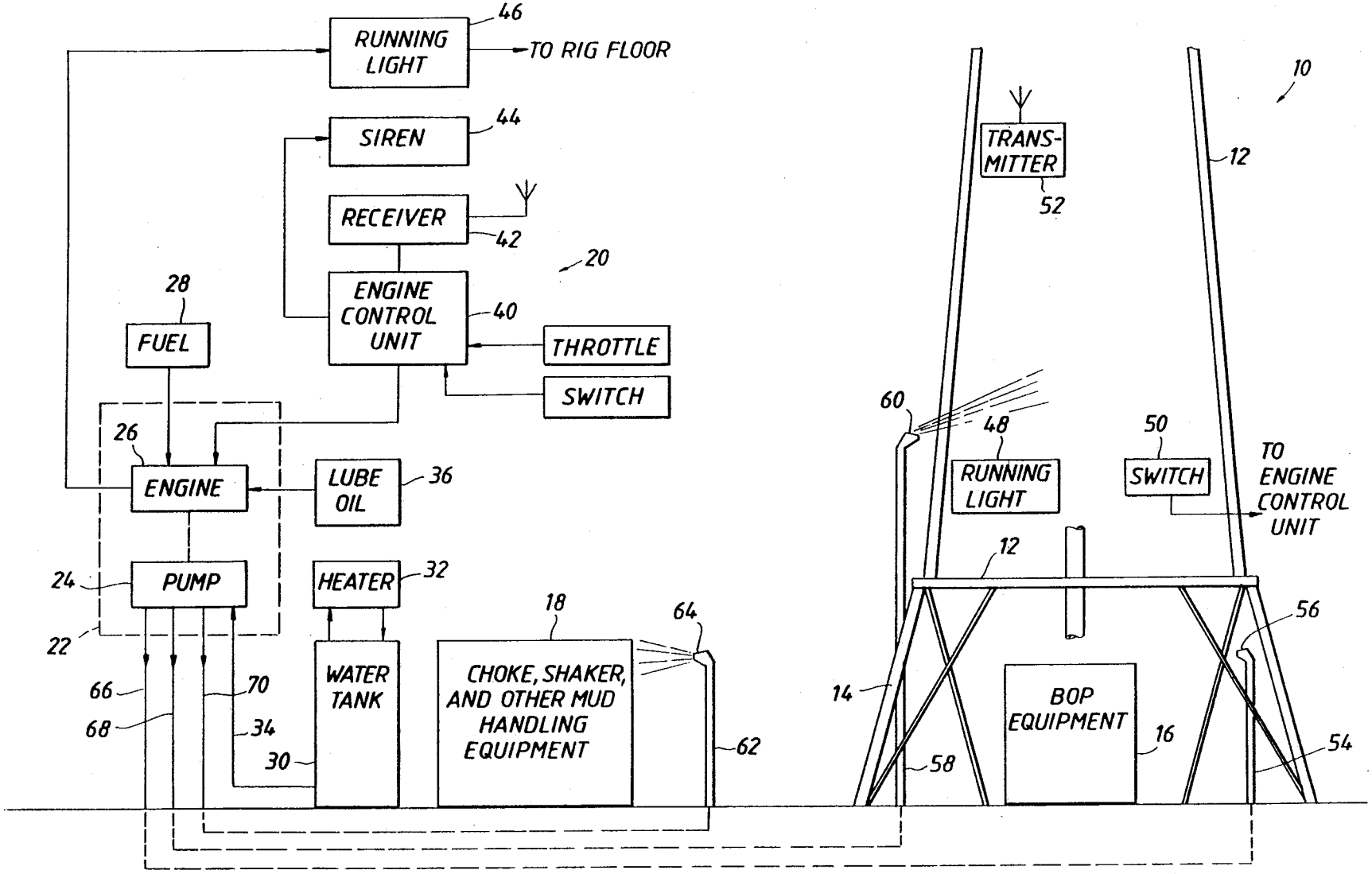
10
12
TO ENGINE CONTROL UNIT
56
54
50
SWITCH
16
BOP EQUIPMENT
TRANS-MITTER
52
48
RUNNING LIGHT
12
58
60
14
62
64
18
CHOKE, SHAKER, AND OTHER MUD HANDLING EQUIPMENT
46
TO RIG FLOOR
44
42
20
40
THROTTLE
SWITCH
RUNNING LIGHT
SIREN
RECEIVER
ENGINE CONTROL UNIT
36
32
LUBE OIL
HEATER
WATER TANK
30
34
70
28
FUEL
26
ENGINE
PUMP
66
68
24
22

WELL PROTECTION APPARATUS AND METHOD

BACKGROUND OF THE DISCLOSURE

The process of drilling an oil or gas well is a dangerous process which involves the risk of fire. The risk of fire is particularly well known, but in spite of the high level of risk, fires are relatively few and far between. Nevertheless, they occasionally do happen on or at the drilling rig. The risk of fire is increased during certain drilling circumstances. Specifically, the risk of fire can be increased markedly when the well penetrates a high pressure natural gas formation. In that event, the well may experience a surge in which the high pressure natural gas flows up the well borehole during drilling. For that reason, the normal, safe operating procedures require that the well be protected by filling the well with a heavy weight drilling fluid, normally known as drilling mud. The drilling fluid is placed in the well to maintain a column of fluid acting on the formation which overcomes the gas pressure. This prevents a surge of natural gas from flowing rapidly up the borehole and escaping at the surface. In addition to that protection, there is also a blow out preventer (BOP) which is installed at the surface, typically being installed beneath the floor of the drilling rig. The blow out preventer is an emergency device which clamps off flow through the borehole.

Occasionally, problems can still arise even though the foregoing protective procedures are fully practiced. For instance, it may be necessary to use an oil base drilling fluid as opposed to a water base drilling fluid. There is another circumstance in which the risk of fire is increased. One example of this involves horizontal drilling. A good example of horizontal drilling is found in the formation which is known as the Austin Chalk which is a formation having various producing strata at about 7000–9000 feet in depth stretching from approximately Laredo, Tex. to the Northeast and extending almost to the Red River. The Austin Chalk is a tight formation which can be produced from vertical wells provided the well passes through the formation and intercepts a formation fracture. Wells of this sort can produce from the tight formation, but the well life has been somewhat shortened because of difficulties in lateral migration through the formation. In a number of occasions, vertical wells into the Austin Chalk have been produced for the useful lives and when that production has been depleted, the wells have been reworked by redrilling the last few hundred feet of the well. Typically, this involves the use of a milling tool to cut a window in the casing in the well, the window being about 100–300 feet in length, and then reentering the well at that region with the appropriate equipment to drill from or through the window in a radius of curvature until the well is then horizontal or substantially so. This requires that the deviated well form a horizontal leg which is ideally centered in the Austin Chalk and is ideally positioned at the midpoint of the formation. The horizontal leg can be several hundred feet long. Indeed, this rework procedure has proven so popular that it has now been adapted for new wells into the Austin Chalk formation.

Assume for purposes of description that the horizontal portion is to be 1000 feet in length. This forms an open hole of approximately 1000 feet in length in the Austin Chalk formation which is a producing formation with a substantial formation pressure drive. In that event, the entire drilling process through the Austin Chalk involves drilling while producing. That is, during the process of extending the horizontal leg to 1000 feet, the Austin Chalk formation will produce at all points along this horizontal leg and thereby seriously increase the risk of drilling. As the partially completed horizontal leg extends through the Austin Chalk, more and more oil or gas or both is produced and comingles with the drilling fluid. Since the drilling fluid is circulated to the well head in the annular space of the borehole, the mud handling procedures at the surface are frought with danger of fire because the oil and gas produced during this time is brought to the surface. There is a risk of fire where the annular flow comes to the surface which is immediately under the drilling rig at the BOP. There is an additional chance of fire hazard in the equipment area where the mud is also handled by the choke equipment, the shale shaker or other mud handling equipment. This equipment is normally deployed at one region at the time of rigging up. Suffice it to say, the circulation of drilling mud through the Austin Chalk brings to the surface some oil or gas, and thereby increases in the risk of fire.

SUMMARY OF THE INVENTION

The present apparatus is fire control system to be installed at a drilling rig. It is particularly adapted for use at a rig where the well to be drilled will have greater exposer to fire and other hazards of this sort. For instance, if the well is to be drilled through the Tuscalosa Sand which yields extremely high pressure natural gas, this type of equipment would be highly desirable. It is installed either at spudding in or at least in the first or three days of operation. It is installed and left at the rig until the well has been completed. The equipment utilizes spray nozzles which are mounted at selected locations to put out any fire which might occur. Indeed, the equipment is installed, switched on, and operated in a standby mode throughout the drilling interval. When drilling is finished, it can be removed to another drilling location and reused at that location. In particular, the equipment features a standby mode of operation so that it is always ready to operate by delivery a flood of water. Indeed, the delivery rate can be as high as 1200 gallons per minute for fire protection. The equipment features a portable engine and pump which are connected to strategically located nozzles. An engine control unit sets the throttle of the engine at a desired engine speed and is changed to full output in the event of a fire by suitable switches which are located at or on the rig floor. By this approach, the personnel on the rig floor are able to initiate fire protection with minimal time delay.

DESCRIPTION OF THE DRAWINGS

The drawing with the present disclosure sets forth the fire protection apparatus of this disclosure installed at a drilling rig and particularly shows how nozzles are positioned at selected locations to protect the major work areas at the rig site.

DETAILED DESCRIPTION OF THE PREFERRED EMBODIMENT

Attention is directed to FIG. 1 of the drawings where the numeral 10 identifies a drilling rig. The rig will be described first to provide the context of the present invention which will be described in detail with the understanding that it is placed on a typical drilling rig where fire protection is needed. The drilling rig 10 incorporates an upstanding derrick 12 which is assumed to have four edges which extend upwardly to the crown (not shown). Obviously, the rig can have other types of construction including the typical tilt up rig where the derrick is constructed differently. The numeral 12 identifies a rig floor which supports a drive system connected with a rotary table (not shown). The rig floor is located several feet above the ground and is supported on a support structure 14. The floor is sufficiently high above the structure 14 that there is room beneath the rig floor for the BOP equipment 16. That is normally installed below the rig floor to clamp around the drill pipe. That is, the BOP equipment 16 is installed around the drill pipe. There is a flow pathway downwardly through the drill string for drilling mud which is delivered by a mud pump where the mud circulates downwardly through the drill bit, and flows back up in the well. This return flow is in the annular space on the exterior of the drill pipe and the drilling fluid returns to the surface and is removed to the side for recycling. The drilling mud flow normally directs the mud through various recovery devices such as shale shakers or desanders. In addition, a degasser may also be connected with the mud flow. In any event, the BOP 16 is normally located beneath the rig floor and immediately adjacent to the upper end of the borehole to operate in the intended fashion.

The drilling mud is directed through the various pieces of equipment identified at 18 which includes the choke, the shaker, and other mud handling equipment. These are normally deployed in a group, and typically includes two or three mud pits. In particular, there will be a mud pump, the choke and the control equipment for the choke, degasser, desander, or shale shaker.

The present apparatus is generally identified by the numeral 20. This equipment is preferably installed somewhat remote from the rig floor 12. In the event of fire, the fire will normally occur at two or three locations and the protective equipment 20 is located remote from these locations to assure that it is clear of the fire so that it can operate to provide fire protection. Thus, the protective equipment 20 is positioned somewhat remote from the BOP 16 and is also remote from the mud handling equipment indicated generally at 18. The present apparatus is ideally portable, at least portable by means of a flatbed trailer, and to this end, it incorporates a skid 22 which supports the pump 24 and a diesel engine 26. These are commonly mounted on a single skid. A second skid is normally included to support a fuel tank 28. The fuel tank 28 provides sufficient fuel for operation for several days, e.g., 7 days. The remainder of the equipment shown in the drawing is relatively small and normally located on the skid 22 as will be detailed.

The fire protection equipment utilizes a large water tank 30. Preferably, a closed tank can be used, typically one that holds about 500 barrels of water. Such tanks are routinely available. The tank 30 is provided with an optional heater 32. In northern climates, it may be necessary to add the heater so that the water is sufficiently heated that it does not freeze. Of course, the heater can be omitted should this not be a problem. The tank 30 is connected with a large diameter hose extending to the pump 24. A typical pump provides an output of 1200 gallons per minute with a discharge pressure of about 130 psi. The preferred form of pump is relatively simple, and to this end, a centrifugal pump will suffice. To handle this kind of flow, a flow line 34 is connected from the tank to the pump 24. Typically, the flow line is perhaps a 6 inch suction line. The pump 24 is connected directly to the engine 26. In the preferred form of equipment, both units are mounted on the common skid which is equipped with eyelets at the top so that the skid mounted equipment can be lifted as a unit. A suitable engine is a 6 cylinder diesel provided by Cummings Engine Company, Inc. capable of 177 BHP. This typical engine has an idle speed of about 800 rpm. It has an adjustable throttle which permits it to be set at desired speeds, and in this particular embodiment, it is operated at a continuous speed of perhaps 1500 rpm. Maximum output with peak torque is obtained at about 2500 rpm. More will be noted regarding these throttle settings hereinafter.

The skid mounted engine 26 normally requires a specified quantity of lubricating oil in the crank case. A supplemental lube oil supply is finished at 36. In addition, the fuel for the engine 26 is provided by the large tank 28 mounted on a separate skid. The engine is normally operated at one of three speeds. Idle speed was mentioned above and that occurs when the equipment is first switched on. The speed is set to a higher level, perhaps 1200–1500 rpm, by an engine control unit 40. This accomplishes that speed simply by positioning the throttle for operation at a selected speed. The engine control unit adjusts the speed to full power at about 2500 rpm. The engine control unit is provided with a radio receiver 42. When a signal is provided by the receiver 42 to the engine control 40, the engine throttle is moved to the higher speed, namely 2500 rpm. This setting will be described as maximum power output. The engine control unit really has two operative states. One which is at the standby speed, and the other is at maximum power. The engine control unit is also connected with a siren or other alarm device. The siren 44 is included to provide a clear warning to rig personnel including those remote from the rig floor, e.g., those sleeping in temporary quarters nearby.

The skid 22 supports a running light 46. The running light is duplicated at two locations. There is one immediately on the skid. It is sufficiently large that it can be viewed even in the darkest of conditions, even when obscured with fog, etc. There is a parallel light 48 which is located on the rig floor. Both lights are operated when the engine 26 is running. This provides a positive signal to personnel that the equipment is operating. The rig floor is the location of two important pieces of equipment involved in the fire protection system 20. One is the running light. It provides the clear indication to personnel on the rig floor that the equipment is successfully operating to provide a fail safe warning. Thus, if the engine 26 stops operating for any reason, the lights 46 and 48 go out and that provides the necessary safety feedback for personnel. Assume for purposes of description that the tool pusher is the person in charge. The tool pusher will watch the running light 48 at all times. In addition to that, the tool pusher is usually adjacent to a switch 50 which connects with the engine control unit 40. That is, the switch can be wired directly to the engine control 40. The switch does not switch the engine control off; rather, it switches the equipment from the standby speed to maximum power operation. The switch 50 is connected by means of a fixed wire which is safely installed out of harms way extending from the rig floor. It is available for operation by the tool pusher at any time. A duplicate switch can be placed on the rig floor if desired so that the driller might also operate the equipment. An alternate mode of asserting control over the fire protection equipment 20 is accomplished by a hand held portable transmitter 52. It is a portable device which communicates with the receiver 42. It provides an alternate signal. The transmitter 52 can be implemented by means of a relative small hand held transmitter which fits in the pocket of a key or selected personnel around the rig. The transmitter 52 can be placed in the pocket of any roughneck anywhere on the rig even up in the derrick, for instance, up on the monkey board. First and second separately located switches can be included for different personnel to operate, e.g., one for the driller, and another for the tool pusher. Also, the alarm devices are at spaced locations.

The present equipment utilizes selected nozzles with standpipes. A standpipe 54 supports a nozzle 56 under the rig floor 12 directed at the area of the BOP 16. In similar fashion, a standpipe 58 extends well above the rig floor and supports a nozzle 60 above the rig floor, perhaps 10 feet over the floor. A third standpipe 62 supports a nozzle 64 directed at the choke and other equipment. All three of the nozzles are directed in a fixed direction. All three are provided with an outlet to provide a broad spray as opposed to a narrow stream of water. All three are constructed with the standpipes momentarily or temporarily anchored in position and of sufficient strength to resist the reaction force that arises from operation. All three are connected by means of fire hoses line extending from the three respective standpipes to the pump 24. The pump is provided with an outlet header which connects with the three fire hoses identified at 66, 68, and 70.

Deployment of the equipment is accomplished along the lines described hereinabove, namely, at an early point in the drilling routine when the derrick and drilling rig are first installed and the safety equipment of the present disclosure is installed and switched on. The tanks 28 and 36 are filled and the engine is turned on. Of course, the water tank 30 is also filled. It is characteristic of a centrifugal pump that it will not provide an output flow at an idle speed. Accordingly, the hoses 66, 68, and 70 are installed by connection with the pump outlet header and are extended to the respective nozzles deployed as illustrated. These hoses are substantially empty of water at this juncture because the pump 24 has no output flow. By contrast, when the engine 26 is raised to maximum power output, the pump 24 will speed up to provide full suction at the input and will deliver several hundred gallons per minute through the three hoses. The water flows through the hoses and is delivered through the three respective nozzles to form a sprayed fog or mist of substantial water volume directed to the suspect fire areas.

Several options can be incorporated in the present apparatus. For instance, the number of nozzles can be varied and additional nozzles can be located as desired. In another modification, a foaming agent can be added to the water either at the tank 30 or otherwise input to the pump 24 along with the flow of water. When the water flow starts, the siren 44 is triggered. This provides an alarm device to all personnel. In addition to that, an important feature is the provision of the signal, typically a visual signal, provided by the running lights 46 and 48. These two signals are useful to assure rig personnel at all times that the equipment is in a ready to operate condition. Obviously, if the fuel tank 28 is emptied and the engine switches off for lack of fuel, the absence of that light is an alarm condition suggesting to rig personnel that they ought to stop drilling and restart that equipment to assure the continued provision of safety at the rig site.

The present apparatus can provide a spray of water within about 1.5 seconds of providing the signal. Thus, the switch 50 is operated forming a signal to the engine control unit. This changes the speed of the engine 26 and initiates water pumping from the pump 24. There is only a modest time delay as water is drawn from the tank 30 into the pump 24 and then is delivered through the fire hoses 66, 68, and 70. The 1.5 second time delay is typical where the hoses are approximately equal in length and are approximately 200 feet or less in length. Preferably, the hoses have a nomimal size of 3 inches and the nozzles are compatible for this size. With three hoses and a nominal 3 inch nozzle, approximately 1200 gallons per minute through put can be provided.

While the foregoing is directed to the preferred embodiment, the scope is determined by the claims which follow.

What is claimed is:

1. A portable safety system for use on a drill rig having a rig floor, the safety system comprising:

(a) a water pump connected to an engine;

(b) water lines connected between said pump extending from said pump and connected to nozzle means for directing water from said nozzle means toward the drilling rig to be protected thereby;

(c) control means connected to said engine to switch said engine to a selected maximum power output from a selected minimum power output, said control means including:

(i) switch means operable by any rig personnel on the rig;

(ii) engine control means connected to said engine to control operation thereof; and (iii) wherein said switch means connects to said control means for control thereof; and (d) engine running signal means forming a continuous signal that said engine is operating at least at said minimum power output, said signal means including means for forming the signal formed thereby for obervation by the rig personnel at the rig.

2. The apparatus of claim 1 wherein said pump and the connected engine are mounted on a skid to enable movement of the pump and the engine as a unit.

3. The apparatus of claim 1 wherein said pump connects with separate water lines and a suction line extends from said pump to a water tank.

4. The apparatus of claim 3 wherein said nozzle means is positioned to spray water on a blow out preventor of the drilling rig, and another nozzle means is positioned to spray water over a rig floor.

5. The apparatus of claim 4 further including a nozzle means for spraying water on mud handling equipment associated with the drilling rig.

6. The apparatus of claim 1 wherein said engine includes a throttle controlling engine power output and said engine throttle has an alternate setting for a reduced power output wherein said engine operates at the reduced power output except when activated by said engine control means.

7. The apparatus of claim 1 wherein said switch means comprises a portable transmitter carried onto the rig floor by the personnel at the rig floor for operation from the rig floor.

8. The apparatus of claim 1 wherein said switch means comprises a wired switch located on the rig floor for operation by the rig personnel.

9. The apparatus of claim 8 further including a second switch means which connects with a portable transmitter which transmits to a receiver located at said control means for said engine to vary operation of said engine.

10. The apparatus of claim 1 wherein said engine running signal means comprises a light mounted on said engine to provide a visual signal of continued engine operation.

11. The apparatus of claim 1 wherein said engine running signal means comprises a light mounted on said rig floor to provide a visual signal of continued engine operation to output power.

12. The apparatus of claim 1 further including alarm means for providing an audio alarm to the personnel near the drilling rig when said engine and said water pump provide water through said water lines to said nozzle means.

13. The apparatus of claim 1 wherein said switch means comprises first and second separately located switches for operation by any rig personnel, and further wherein said engine running signal means comprises two separate signal forming means at spaced locations.

14. The apparatus of claim 13 further including a siren which is operated in response to a signal from said switch means which changes the operation of said engine.

15. A method of protecting a drilling rig during drilling operations comprises the steps of:

(a) positioning nozzle means at selected locations at the drilling rig so that said nozzle means are directed at areas where fire protection is desired;

(b) connecting a pump to a water source and also to said nozzle means to provide water for fire protection;

(c) continuously operating an engine for operating said pump wherein said engine is operated at a reduced power during times at which no wateris needed from said water source;

(d) positioning a switch means at a selected and convenient location at the rig to enable rig personnel to operated said switch means to obtain water from said water source for said nozzle means when the rig personnel determines fire protection is desirable; and (e) forming an engine operation signal by said switch means during continuous operation to enable the rig personnel to observe engine operation by the signal to verify the operation of the engine.

16. The method of claim 15 wherein the step of connecting said pump to said water source includes the step of connecting water flow lines from a portable storage tank to said pump, and connecting separate water flow lines from said pump to said nozzle means.

17. The method of claim 15 wherein the step of continuously operating the engine provides insufficient power for operation of said pump connected to said engine and provides maximum power from the engine to the pump to pump water from said water source at a maximum flow rate from the pump for delivery through the nozzle means.

18. The method of claim 17 further including the step of operating the engine continuously at a reduced speed and increasing engine speed to provide water from said water source at a maximum reate and also forming an engine operation signal indicative of delivery of pumped water.

* * * * *